United States Patent [19]

Hamblin

[11] 4,033,540

[45] July 5, 1977

[54] SHELF SUPPORTS

[75] Inventor: Richard David Hamblin, Birmingham, England

[73] Assignee: Archibald Kenrick and Sons Limited, West Bromwich, England

[22] Filed: Apr. 21, 1975

[21] Appl. No.: 569,994

[30] Foreign Application Priority Data

May 16, 1974 United Kingdom ..... 21731/74

[52] U.S. Cl. ..... 248/246

[51] Int. Cl.[2] ..... A47G 29/02

[58] Field of Search ..... 248/241, 243–246, 248/226 R; 108/108

[56] References Cited

UNITED STATES PATENTS

| | | | |
|---|---|---|---|
| 766,605 | 8/1904 | Dilg | 248/246 |
| 830,232 | 9/1906 | Jordan | 248/246 |
| 1,041,264 | 10/1912 | Freud | 248/245 |
| 2,677,519 | 5/1954 | Hobson | 248/246 X |
| 3,865,337 | 2/1975 | Towfigh et al. | 248/246 |

FOREIGN PATENTS OR APPLICATIONS

| | | | |
|---|---|---|---|
| 16,733 | 7/1904 | United Kingdom | 248/246 |

*Primary Examiner*—Roy D. Frazier
*Assistant Examiner*—Terrell P. Lewis
*Attorney, Agent, or Firm*—Finnegan, Henderson, Farabow & Garrett

[57] ABSTRACT

A shelf support comprising a member adapted for attachment to a wall or other structure said member defining a lipped internal channel of uniform dimensions throughout its length, and a shelf support bracket having a shelf supporting portion and a portion engageable in the lipped channel, and arranged to extend lengthwise thereof, the latter portion carrying a pair of wedges disposed within the channel, that portion being engageable between the wedges to hold the bracket against movement lengthwise of the member, said portion of the bracket being removable from such position between the wedges to allow the bracket, together with the wedges to be moved lengthwise of the member.

3 Claims, 3 Drawing Figures

SHELF SUPPORTS

This invention relates to shelf supports of the kind comprising at least one member adapted for attachment vertically to a wall or other structure, on which a shelf is to be mounted, and at least one shelf support bracket which is detachably securable on the member in any one of a number of alternative positions along the length thereof.

It is usual to provide two or more of the members with repective brackets secured thereon, for a single shelf. More than one bracket may be provided on each of the members to support more than one shelf respectively.

The object of this invention is to provide a shelf support of this kind in a form which permits stepless adjustment to be carried out in a particularly simple way, a shelf being held securely so that the risk of a shelf falling through overloading is minimised.

In accordance with the present invention a shelf support comprises a member adapted for attachment to a wall or other structure said member defining a lipped internal channel of uniform dimensions throughout its length, and a shelf support bracket having a shelf supporting portion and a portion engageable in the lipped channel, and arranged to extend lengthwise thereof, the latter portion carrying a pair of wedges disposed within the channel, that portion being engageable between the wedges to hold the bracket against movement lengthwise of the member, said portion of the bracket being removable from such position between the wedges to allow the bracket, together with the wedges to be moved lengthwise of the member.

Figure 3:
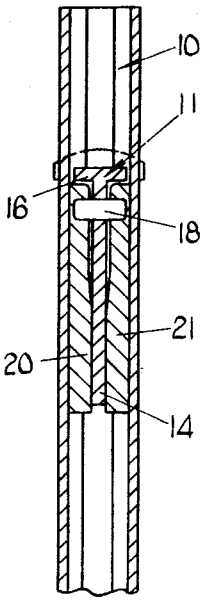
Figure 1:
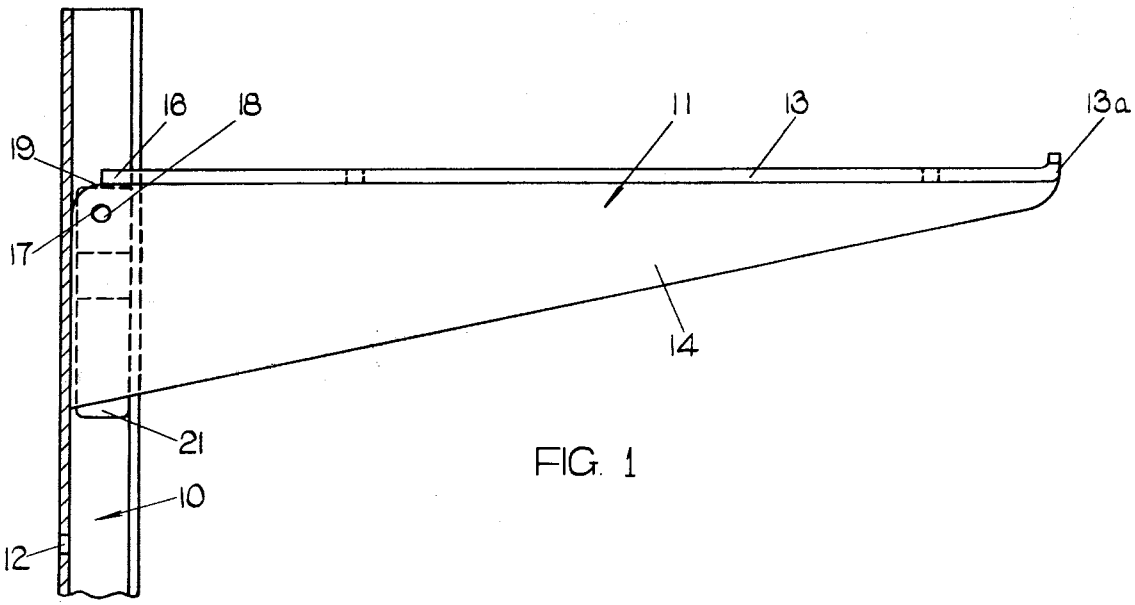
Figure 2:
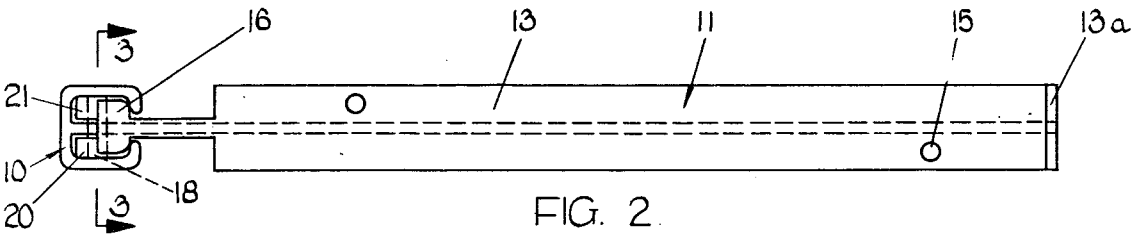

The invention will now be described by way of example with reference to the accompanying drawings in which:

FIG. 1 is a side elevation view of a shelf support constructed in accordance with the invention, FIG. 2 is a plan view thereof, and FIG. 3 is a sectional view on the line 3—3 in FIG. 2.

The shelf support comprises a member 10 for attachment to a vertical surface on which a shelf is to be mounted and a shelf support bracket 11 securable at any selected position along the length of the member 10 as will be described.

The member 10 is of channel cross section with inward turned lips as shown in FIG. 2. The member 10 is of uniform cross section throughout and is adapted for mounting on to a vertical surface by means of screws or other fastenings engageable in holes 12 spaced lengthwise of the member.

The shelf support bracket 11 is of substantially T-shaped cross section over the greater part of its length defining a narrow platform 13 integrally connected with a generally triangular flange 14. The platform 13 has spaced drills 15 to accept screws or other fastenings whereby a shelf can be secured thereto. The platform 13 terminates at a position spaced from the member 10 into which however the triangular flange 14 extends. Furthermore there are two integral projections 16 which are co-planar with the platform 13 and which engage behind the lips of the channel of the member 10 respectively. The free end of the platform 13 has a short upstanding portion 13*a*.

In the corner of the triangular flange 14, at which these projections 16 are provided, there is a hole 17 to accept a pivot pin 18. Moreover this corner of the triangular flange is radiused at 19.

The pivot pin 18 extends into a pair of wedges 20, 21 which are disposed within the member 10. Each of these wedges is of generally rectangular configuration having, however, tapered inwardly presented surfaces disposed at opposite sides of the triangular flange 14 of the shelf support bracket 11. The wedges 20, 21 are of a size such that when the flange 14 is disposed between them, as illustrated in the drawings, they fill the remaining space in the channel defined by the member 10 so as to grip the flange 14 and prevent the shelf support bracket 11 sliding downwardly of the member 10. The wedges are preferably made from a resilient material which may be a plastics material, and the member 10 may have sufficient resilience to allow limited expansion so as to create maximum frictional resistance to sliding movement of the wedges 20, 21 within it.

The shelf support bracket with its platform 13 substantially horizontal is thus prevented from sliding lengthwise of the member 10, that is normally in a vertical direction, not only by the frictional forces between the wedges 20, 21 and the channel of the member 10, but also by the cantilever effect of the bracket. Frictional engagement takes place between the projections 16 and the lips of the member 10, and also between the vertically disposed edge of the triangular flange 14 against the interior of the base of the channel.

If it is desired to adjust the position of the shelf support bracket 11 lengthwise of the member 10 it is necessary to pivot the shelf support bracket about the pivot pin 18 so as to withdraw the flange 14 from between the wider end portions of the two wedges 20, 21. The assembly comprising the shelf support bracket 11 and the two wedges 20, 21 can now slide lengthwise of the member 10 without however becoming detached therefrom. When the correct adjusted position is reached, the shelf support bracket 11 is pivoted downward to the position shown in the drawings whereupon wedging engagement takes place to secure the bracket.

To support a shelf it is usual to provide two or more of the members 10 which should be substantially parallel. Shelf support brackets 11 are fitted into these members 10 respectively and the height thereof can be adjusted in a stepless manner as required. More than one shelf support bracket 11 may be provided on each one of the members 10 respectively. Fitting and removal of the shelf support brackets to the members takes place at the end of the members but cannot be accomplished at any point between the ends.

The form and configuration of the platform of the shelf support bracket may vary in accordance with the kind of shelf to be supported.

I claim:

1. A shelf support comprising a member adapted for attachment vertically to a wall or other structure, said member including an internal channel of uniform dimensions throughout its length and an outwardly facing slot formed by a pair of opposing lips;

a bracket having a shelf-supporting portion and a generally triangular flange depending from the shelf-supporting portion, said flange including a blade portion extending into said channel through said lips;

a pair of projections extending outwardly from the upper edge of said blade portion for engaging the inner surfaces of said lips; and a pair of channel-engaging wedges pivotably supported by said blade portion and extending along the surfaces of the blade portion extending into said channel, said blade portion being frictionally inserted between said wedges and having a surface for engaging the inner rear surface of said member for rigidly supporting said bracket against movement in said channel, both by the oppositely acting purely frictional engagement between the lip-engaging projections and the channel-engaging surface of the blade portion, and the frictional engagement of said wedges with the channel by insertion of the blade portion for infinite adjustability of said bracket.

2. The shelf support as claimed in claim 1, wherein said bracket is pivotable about said projections and wherein said blade portion may be pivoted at least partially outwardly from between said wedges releasing both the purely frictional engagement and the frictional wedge support for movement of the bracket with respect to said member.

3. A shelf support as claimed in claim 2 in which the wedges are pivoted to the blade portion of the flange by a pivot pin passing through the blade portion at one corner thereof.

* * * * *